United States Patent [19]

Kolm et al.

[11] Patent Number: 4,498,851

[45] Date of Patent: Feb. 12, 1985

[54] SOLID STATE BLOWER

[75] Inventors: Henry H. Kolm, Wayland; Eric A. Kolm, Brookline, both of Mass.

[73] Assignee: Piezo Electric Products, Inc., Cambridge, Mass.

[21] Appl. No.: 477,630

[22] Filed: Mar. 22, 1983

Related U.S. Application Data

[63] Continuation-in-part of Ser. No. 142,348, May 2, 1980, abandoned, which is a continuation-in-part of Ser. No. 036,812, May 7, 1979, abandoned.

[51] Int. Cl.[3] ..... F04B 35/04

[52] U.S. Cl. ..... 417/322; 416/83; 417/436

[58] Field of Search ..... 417/322, 24, 436; 416/81, 83

[56] References Cited

U.S. PATENT DOCUMENTS 3,963,380 6/1976 Thomas ..... 417/322

FOREIGN PATENT DOCUMENTS 167983 3/1951 Austria ..... 417/436

*Primary Examiner*—Richard E. Gluck

*Attorney, Agent, or Firm*—Joseph S. Iandiorio; William E. Noonan

[57] ABSTRACT

A pumping device comprising: a housing; piezoelectric element having one end mounted to the housing and one end free; a generally planar impeller blade connected to the free end of the piezoelectric element and having its distal end unconstrained by the housing; the blade having a high Q factor, a high stiffness-to-weight ratio and a low mass per unit area substantially less than that of the piezoelectric element; a voltage is applied to the piezoelectric element for oscillating its free end perpendicular to its plane at or close to resonance and propagating a traveling wave along the blade to generate and shed vortices at the distal end of the blade.

1 Claim, 20 Drawing Figures

SOLID STATE BLOWER

FIELD OF INVENTION

This invention relates to a piezoelectric blower and more particularly to such a blower having an improved impeller blade.

RELATED CASES

This application is a continuation-in-part of application Ser. No. 142,348, filed May 2, 1980, now abandoned, which is a continuation-in-part of application Ser. No. 36,812, filed May 7, 1979, now abandoned.

BACKGROUND OF THE INVENTION

Electronic equipment is customarily cooled using rotary fans or blowers, which circulate air through the entire housing to maintain a constant operating temperature. Steady state temperature maintenance of the electronic components is important not only to prevent overheating, but also to assure reliable operation.

Most electronic equipment now contains only solid state electronic components, such as miniaturized transistors and integrated circuits, and no longer utilizes vacuum tubes and other generally large heat producing components. The amount of cooling required to maintain stable operating temperatures has therefore been substantially reduced. Also, the cooling requirements have been localized, since only several very small components, typically mounted on printed circuit boards, actually require cooling. Thus, cooling of the entire cabinet is not required. Nevertheless, even though wasteful, electronic equipment has continued to be cooled in this manner, since neither rotary fans nor other cooling devices have successfully been miniaturized, and rotary fans, which have been substantially improved over the years, continue to offer the most reliable and efficient method of cooling. Comparatively, however, when used in solid state electronic equipment, rotary fans or blowers stand out as the largest, noisiest, and most short-lived part of the assembly, the only moving component, and the component which most severely limits environmental tolerance specifications.

Another form of blower, using the principle of a vibrating blade, has been proposed in the past. Austrian Pat. No. 167,983 to Anderle, and U.S. Pat. No. 4,063,826 to Riepe are typical of such designs. In the Riepe patent a flexible blade is driven magnetically to deflect from side to side. The blade bends back and forth about a node point. The flapping end of the blade to the outside of the node point is disposed in a pumping duct to pump liquid through the duct. In the Anderle patent, a flexible blade is fixedly mounted at the inlet end of a blower duct and driven magnetically from side to side. Theoretically, due to the few moving parts, blowers of these types are susceptible of miniaturization; as a practical matter, however, they are generally so inefficient that they are better suited for producing heat than for generating cooling air movement, with the result that none has found any significant commercial acceptance.

SUMMARY OF INVENTION

It is therefore an object of this invention to provide an improved, highly efficient, inexpensive, and reliable piezoelectric blower.

It is a further object of this invention to provide such a piezoelectric blower having highly effective impeller blade motion far in excess of that obtainable from the piezoelectric element alone.

It is a further object of this invention to provide such a piezoelectric blower in which the impeller blade is driven with traveling wave motion.

It is a further object of this invention to provide such a piezoelectric blower in which the traveling wave motion of the impeller blade generates and sheds vortices which move fluid without valves or ducts.

The invention results from the realization that an improved piezoelectric blower can be achieved using a generally planar impeller blade connected to the free end of a piezoelectric element and having its distal end unconstrained by any surrounding housing, with the blade having a high Q factor, a high stiffness-to-weight ratio and a mass per unit area substantially less than that of the piezoelectric element.

The invention features a pumping device including a housing, a piezoelectric element having one end mounted for the housing and one end free, and a generally planar impeller blade connected to the free end of the piezoelectric element. The distal end of the impeller blade is unconstrained by the housing. The blade has a high Q factor, a high stiffness-to-weight ratio and a mass per unit area substantially less than that of the piezoelectric element. There are means of applying a voltage to the piezoelectric element for oscillating its free end perpendicular to its plane at or close to the resonance frequency of the cantilevered blade and propagating a traveling wave along the blade to generate and shed vortices at the distal end of the blade where it is unconstrained by the housing.

In the preferred embodiment, the traveling wave propogated along the blade is a quadrature wave, the Q factor is at least 8 and the stiffness-to-density ratio of the blade is more than one million newton-meters per kilogram. The blade and piezoelectric element are of uniform width and thickness and the mass per unit area of the blade is less than sixty percent of the mass per unit area of the piezoelectric element.

The piezoelectric element or bilaminate applies a sinusoidal driving force to the blade for propagating a traveling flexure wave along the blade, preferably in a quadrature relation. The entire length of the blade is thus free to move laterally as it is driven back and forth by the piezoelectric element. The piezoelectric bilaminate is a strip consisting of two layers of piezoelectric ceramic polarized in opposite directions which on their facing sides are separated by a conducting layer and on their outside faces are surrounded by conducting layers. The two outside conducting layers are connected as electrodes to a controlled alternating current supply. Since the piezoelectric layers have opposite polarity, voltage applied across the bilaminate strip induces bending of the element. Accordingly, alternating voltage across the piezoelectric element drives the blade back and forth at the point of attachment. More than two layers of ceramic may be used if desired, and connected in parallel to lower the operating voltage.

The blower operates without any substantial mechanical friction to permit high operating speed, high throughput relative to size, virtually unlimited service life, and it may be minitiarized and still produce a significant flow of air to cool miniature components. In its miniaturized form, the device may be mounted directly on printed circuit boards, alongside the individual components which require cooling, and due its high efficiency it will provide sufficient cooling air.

The blower preferably is constructed with a pair of counter-oscillating blades in parallel so that it is dynamically balanced and vibration free.

BRIEF DESCRIPTION OF THE DRAWINGS

For a better understanding of the invention, reference may be had to the following detailed description of the preferred embodiments, taken in conjunction with the accompanying drawings, in which.

DETAILED DESCRIPTION OF PREFERRED EMBODIMENTS

Figure 1:
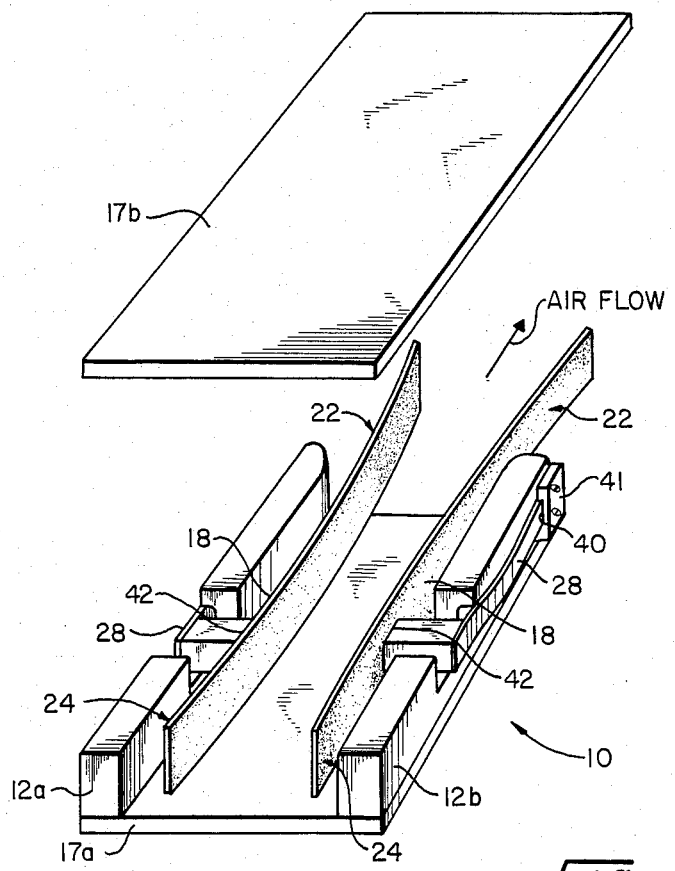
FIG. 1 is a pictorial view of a solid state blower having a pair of blades driven by piezoelectric elements according to the invention.

Referring to FIG. 1, a solid state blower according to the present invention has a housing 10, outer walls 12*a*, 12*b* and bottom 17*a* and top 17*b* lifted out of the way for clarity. A pair of resilient blades 18 having inlet ends 22 and outlet ends 24 are mounted in housing 10.

A piezoelectric bilaminate 28 is attached at one end 40, for example by a plastic holder and screws 41, to each of the housing walls 12*a*, 12*b* and at the other end 42, by cementing or any other suitable means, to a point on each blade 18 to support the blade in the channel 10, in a manner such that upon lateral movement of the bilaminates the blades 18 are free to undergo simultaneous lateral deflection. This mounting arrangement permits free lateral movement of the blade 18 along the entire length with corresponding lateral movement of the end 42 of the piezoelectric element 28.

A piezoelectric element suitable for use in the present invention is marketed by Piezo Electric Products, Inc., Metuchen, N.J., under the name "Piezo Ceramic Bender Element, No. G1195". Each bilaminate strip 28, FIG. 2, has two layers of piezoelectric ceramic 29 separated by a layer of conducting material 30, e.g. brass. The outside layers 32, 34 are conducting (e.g., nickel, silver) and connected to the leads 36, 38 of a controlled alternating current supply 39. The two ceramic layers 29 are polarized in opposite directions, so that voltage across the bilaminate induces a bending motion in the strip. Since the bilaminate strip 28 is fixed on the housing at 41, controlled alternating voltage causes the free end 42 of the piezoelectric element 28 to move back and forth at the voltage frequency. The bending movement of the bilaminates 28, in turn, drives the blades 18 back and forth at the point of attachment 42 at a controlled rate.

Figure 2:
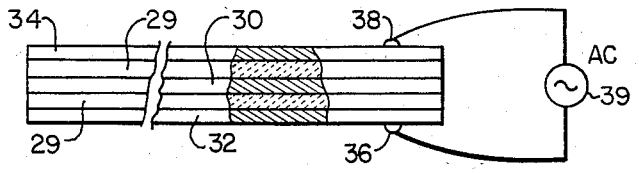
FIG. 2 is a longitudinal-sectional view of a piezoelectric bilaminate driving element for use with the blower of FIG. 1.

Although not illustrated in FIG. 1, the connections from the piezoelectric elements 28 to the power supply 39, FIG. 2, are conveniently made at the end 40, beneath the holder 41.

When driven back and forth, the blade 18 represents a beam subjected to combined bending and shearing loads varying so rapidly that inertial effects dominate to propagate a traveling flexure wave along the impeller or blade from the inlet end to the outlet end. Typically a voltage oscillating in the range of 60–400 hz is applied. The most efficient pumping action results when the driving force is applied in quadrature, that is, to produce a 90 degree phase lag in the oscillation cycle between two points along the blade, as illustrated schematically in FIGS. 3A–3F. The driving force (F) is applied at a single point, and within a selected frequency range depending upon the resonant frequency of the combination of the blade and piezoelectric element, such that the blade undergoes both lateral displacement and bending at the point of applied force. The driving force F on the blade produces the successive blade shapes shown in FIGS. 3A–3F and directions of air motion (A) indicated by arrows, as described below.

Figure 3A:
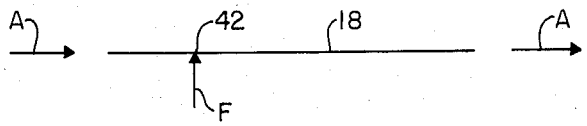
FIGS. 3A, 3B, 3C, 3D, 3E and 3F are schematic representations of first the blade at rest and then the pumping motion of the blade, phased in quadrature, at various points of the oscillation cycle.

Referring to FIG. 3A, with the blade 18 at rest, an initial lateral force F is applied (by the piezoelectric element) to the blade at point 42. Thereafter, the rear portion of the blade 18 moves in the direction shown, with the forward end of the blade lagging, FIG. 3B, due to inertia.

Figure 3B:
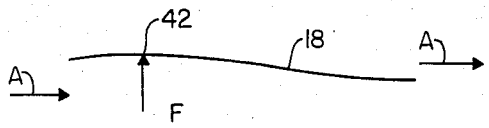
Figure 3C:
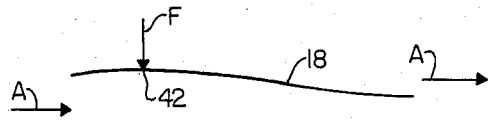
Figure 3D:
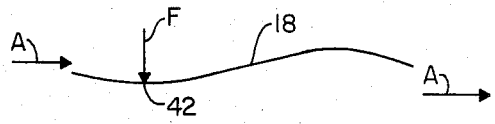
Figure 3E:
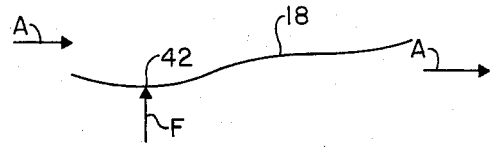
Figure 3F:
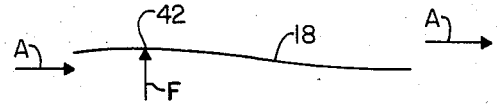

When the rear portion 42 of the blade 18 reaches the maximum deflection, FIG. 3B, the force F applied by the bilaminate is reversed, FIG. 3C, to move the rear portion of the blade in the other direction 16*b*, FIG. 3D. The forward end of the blade, however, continues to lag behind by 90 degrees of the oscillation cycle. When the driven point 42 of the blade reaches maximum deflection in the other direction, the force F is again reversed, FIG. 3E, to move the blade back, with the forward end of the blade again being 90 degrees later in the oscillation cycle, FIG. 3F. Optimum pumping efficiency results when the blade resonance frequency is at or near the driving frequency of the piezoelectric bilaminate assembly 28, since this maintains a quadrature relation between the leading (rear) and lagging (forward end) portions of the blade 18.

In the FIG. 1 embodiment, the blower contains two counter-oscillating blades 18 to operate 180 degrees out of phase with each other. The complementary back and forth motion of the two blades 18 provides dynamic balancing and prevents vibration of the device.

As an example of the efficient operation of the present invention, a miniaturized form of blower constructed in accordance with FIG. 1, having an overall length of about 1.75 inches, a width of 0.75 inches and a height of 0.5 inches, and operated at a frequency of 60 Hz by the piezoelectric bilaminates, produces a sufficient throughput of air and a sufficient output pressure to be capable of blowing out a Zippo wind-proof lighter. Thus the device is very efficient, and in tests has been very stable, with efficiency so high that rises in temperature of the bilaminates have been virtually undetectable.

Figure 4A:
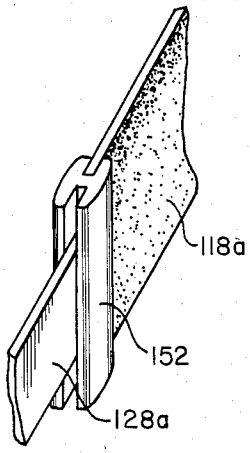
FIG. 4A is an enlarged detail view of an alternative interconnection between the blade and piezoelectric bender.
Figure 4:
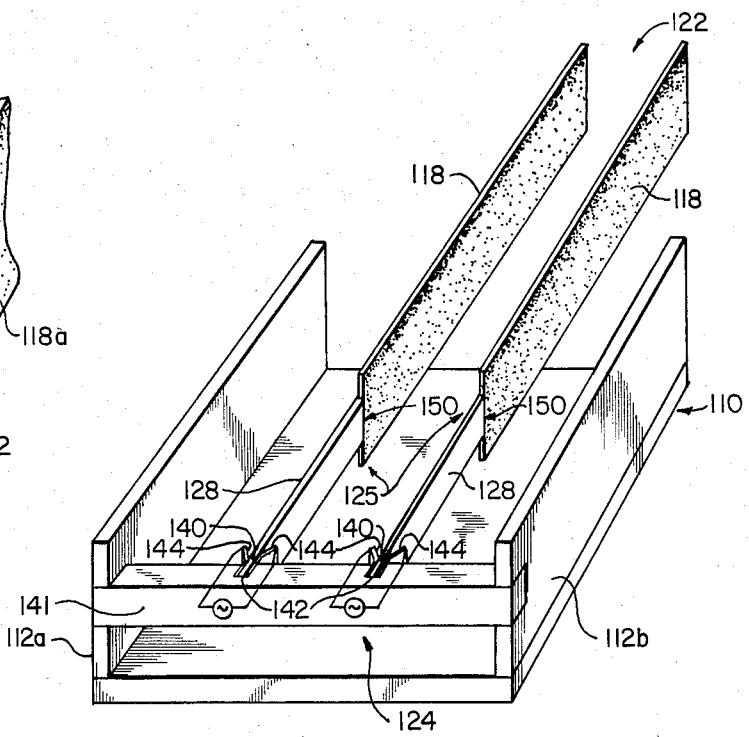
FIG. 4 is a pictorial view of a modified form of the solid state blower shown in FIG. 1.

A modified embodiment of the solid state blower illustrated in FIG. 1 is shown in FIG. 4, where in place of the side mounted piezoelectric element 28, a pair of end-mounted bilaminate piezoelectric elements 128 drive respective ones of a pair of flat resilient blades 118.

The blower assembly includes a housing 110, side walls 112*a* and 112*b* and a bottom plate 117*a*. A top cover may be added if desired, similar to cover 17*b* shown in FIG. 1. Efficient pumping action is achieved without the enhanced valving action produced by the ducts due to the quadrature traveling wave induced in the blades 118.

The piezoelectric bilaminates 128 are mounted at one end 140 to a cross member 141 bridging the walls 112*a*, 112*b* of the housing 110. The member 141 is provided with a pair of vertical slots 142, each of which is sized to snugly receive the end of the bilaminate 128 and a pair of electrically conductive contact leaves 144, one on either side of the bilaminate. Conductors, not shown, are connected to the leaves for coupling to the alternating voltage supply. The free ends of the bilaminates 128 are attached at junctions 150 to resilient blades 118. Alternatively, a doiuble-slotted saddle junction block 152 may be used to attach the resilient blade 118*a* to the free end of the bilaminates 128*a*.

In this mounting arrangement, as in the FIG. 1 embodiment, the blade 118 is not fixed at any point relative to the housing and is free to move laterally (i.e., perpendicular to the flat surface of the blade 118) back and forth along its entire length when driven by the free end of the piezoelectric element 128.

As in the case of the blade in FIG. 1, when alternating voltage is applied across the bilaminates 128, a cyclical back and forth movement occurs in the free ends of the bilaminates 128 which in turn drives the ends of the blade 118 at junctions 150 back and forth in the housing. Since the entire length of the blade 118 is free to move back and forth relative to the housing, a traveling flexure wave is propagated when the blade is driven at an appropriate frequency, i.e. to produce quadrature similar to that illustrated in FIGS. 3A–3F, from the inlet end 124 toward the outlet end 122. Since, however, the propagated wave travels along the blade from one end 125 to the other 122, the blower works very efficiently in pumping fluids, especially air, without the need for valving action. To effect dynamic balancing of the system, the two bilaminates are driven in opposing phase relationship, as in the FIG. 1 embodiment. Although for dynamic balancing purposes, it is preferable to employ a pair of counter oscillating blades, the embodiments of both FIGS. 1 and 4 can provide effective air movement with a single oscillating blade.

Figure 5:
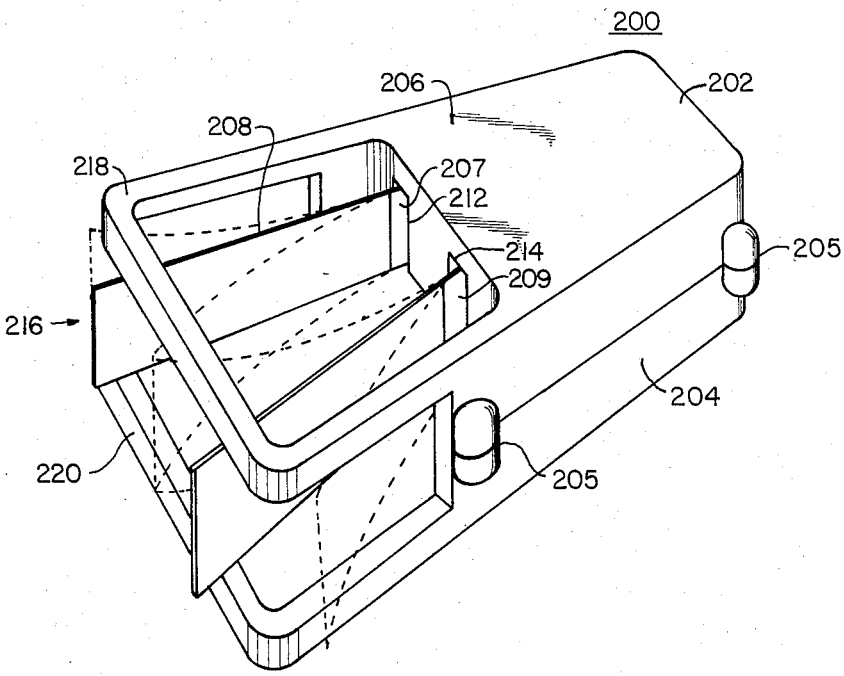
FIG. 5 is an axonometric view of an alternative embodiment of the blower according to this invention.

As recently more fully understood, no ducts, walls or valving are required for the operation of the blower according to this invention. In fact, the blades operate best in free air completely unobstructed. Valving action or flow rectification is accomplished with a process of vortex shedding from the blade tip. In the preferred form, the blower has a housing which provides only mechanical protection without obstructing the flow near the vortex shedding tips of the blades. Such a housing 200 is shown in FIG. 5 as having an upper half 202 and lower half 204, which may be permanently fixed together at sonic weld points 205 for example. The rear closed portion 206 of housing 200 holds the piezoelectric driver elements and their electrical connections. Benders 107, 109 extend slightly beyond rear part closed portion 206 through slots 212 and 214 into the open frame area 216, where they join with blades 108, 210. Frame area 216 includes upper 218 and lower 220 rail portions so that the vortex shedding areas at the tips of blades 208 and 210 are unconstrained by the housing. Rails 218 and 220 are primarily provided as mechanical protection for the blades and, in fact, may be eliminated if desired.

Vortext shedding is a process whereby air is prevented from being sucked around the blade tip when motion reverses. It is based on the fact that air displaced from the front of a moving blade rotates so rapidly that it is unable to reverse its direction of rotation when the blade reverses its motion. If the rotation is not sufficiently rapid, the vortex cap reverse its direction of rotation to be sucked around the blade tip instead of leaving the blade. Vortex shedding is enhanced by, but does not require, exact quadrature motion; that is a 90 degree lag between the root and tip of the blade.

Figure 6:
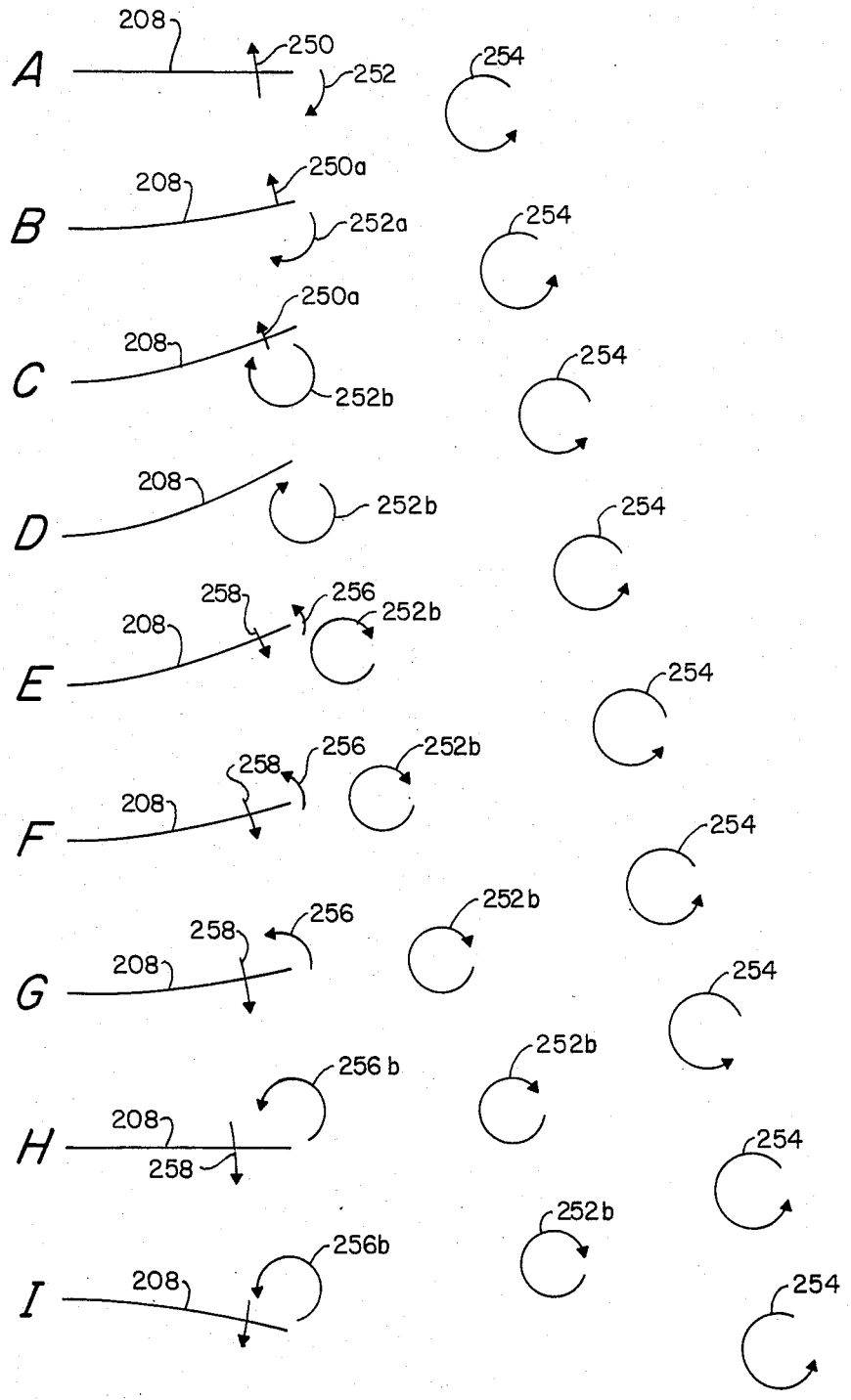
FIGS. 6A–I are a series of schematic illustrations of the generation and shedding of vortices by the blower of this invention.

The vortex shedding action is illustrated in FIGS. 6A–6I. In FIG. 6A, the blade illustratively referred to as blade 208 of FIG. 5 is centered and moving upward at maximimum velocity as indicated by arrow 250, and air is being sucked downward around the blade tip as indicated by arrow 252, while the previously shed vortex 254 is moving to the right below the center line of the blade. In FIG. 6B, the blade is beginning to curve upward at about one quarter amplitude. The air is being sucked around the blade tip into the vacuum on the back side of blade 208 and the new vortex 252*a* is beginning to form while the old vortex 254 is moving farther to the right. The blade nears the end of its travel in FIG. 6C, leaving a fully formed vortex 252*b* in its wake, with vortex 254 still moving outwardly. In FIG. 6D, blade 208 has reached its full excursion and it has stopped moving and is about to reverse with the fully formed vortex 252*b* still in its wake and the previously formed vortex 254 still moving to the right. The blade then starts downwardly again, FIG. 6E. The vortex 252*b* is rotating too rapidly to reverse this motion and it is therefore expelled from the blade area by the new airflow around the blade. The new airflow 256 is moving up around the tip of the blade towards its wake, while the blade is moving in the direction as shown by arrow 258. Upward flow 256 continues to gain speed as it is flows into the vacuum behind the blade, FIG. 6F, and the previous vortex 252*b* is now clear of the blade wake and gaining speed. The blade accelerates towards its center position in FIG. 6G while the air flowing into its wake indicated by arrow 256 is developing a new vortex. In FIG. 6H, with the blade centered and moving downward at maximum velocity as indicated by arrow 258, the air 256 being drawn into the vacuum of the wake has developed into a full vortex 256*b*. Finally, in FIG. 6I the blade 208 is moved further downward, feeding more air into vortex 256*b* in its wake. The two previous vortices 252*b*, 254 are moved toward the right, rotating in opposite directions, one above the axis the other below the axis of blade 208. In this way, a line of oppositely rotating vortices is generated resulting in a highly directional stream of air. If this vortex shedding effect is disturbed by obstructions in the area, the air simply flows from the forward surface of the blade around its trailing edge to the rearward surface of the blade when the motion reverses. There is then only circulation around the trailing edge and very little outward flow.

While normal piezoelectric elements such as benders have amplitudes of several thousandths of an inch typically from 0.01 inch to 0.02 inches, the blower blades of this invention provide amplitudes on the order of one inch.

The material out of which the blade is constructed must have low internal damping. Internal damping is a measure of the material's elasticity, usually expressed in terms of a "Q-factor" which is simply the ratio of peak elastic energy stored to total energy lost during one deformation cycle. For example, once struck, a bell of perfectly elastic material would ring forever. A bell of bronze rings audibly; one of lead does not ring at all. Bronze has a higher Q-factor than lead. In quantitative terms, a perfectly elastic tennis ball would rebound to the same height from which it was dropped. If it rebounded to 90% of the height, it is said to have a Q-factor of 10. One-tenth of the peak energy stored is lost during impact. If it rebounds to half the height, its Q-factor would be 2, half the energy lost. If it landed with a thud like a piece of clay and didn't bounce at all, its Q-factor would be unity. All the stored energy would have been dissipated. For effective blowing action, the blade material in this invention should have a Q-factor of at least 8. Various metals satisfy this requirement, i.e. hard brass, phosphor-bronze, beryllium, copper alloy, steel.

The blade material should have a high stiffness-to-weight ratio. The minimum stiffness-to-weight ratio can be defined as a ratio of Young's modulus over density greater than one million newton-meters per kilogram. Young's modulus is defined as the slope of the stress versus strain curve within the elastic range and has the dimensions of stress over strain, notably newton's per square meter over meters per meter, while density has the dimensions of kilograms per cubic meter; thus the requirement can be expressed as Young's modulus/density greater than one million newton-meters per kilogram.

The blade should also have a low mass compared to the piezoelectric bender. If the mass of the blade is too high, it will cause the bender to break when the blade is driven to a high resonant amplitude and there will not be a discontinuity at the point where the blade joins the piezoelectric bender. For a blade of uniform width and thickness, the maximum mass per unit area of the blade is usually no more than 50 to 60% of the mass per unit area of the bender. Two materials have been found to work very well for the blade, Mylar and G-10. A table showing the stiffness, density and stiffness/density ratio of a number of blade materials, including Mylar and G-10, is shown below:

BLOWER BLADE MATERIALS PROPERTY TABULATION

| MATERIAL | STIFFNESS ($Nt/M^2$) | DENSITY ($Kg/M^3$) | STIFF/DENS RATIO (NtM/Kg) |
|---|---|---|---|
| Steel | $20 \times 10^{10}$ | $7.83 \times 10^3$ | $2/55 \times 10^7$ |
| Brass | $9 \times 10^{10}$ | $8.56 \times 10^3$ | $1.05 \times 10^7$ |
| G-10 | $1.9 \times 10^{10}$ | $1.9 \times 10^3$ | $1.0 \times 10^7$ |
| Mylar | $.379 \times 10^{10}$ | $1.39 \times 10^3$ | $.272 \times 10^7$ |
| Lexan | $.199 \times 10^{10}$ | $1.2 \times 10^3$ | $.166 \times 10^7$ |
| Polyethylene (High Dens.) | $.11 \times 10^{10}$ | $.96 \times 10^3$ | $.114 \times 10^7$ |
| Polyethylene (Low Dens.) | $.026 \times 10^{10}$ | $.91 \times 10^3$ | $.028 \times 10^7$ |

The combined system of the piezoelectric element and the blade should have its resonant frequency equal or approximately equal to the frequency of the applied voltage to an accuracy typically within plus or minus 2% or within $1\frac{1}{4}$ Hz. at a resident frequency of 60 Hz. The blades may be attached to the bender by any suitable means such as by means of a cemented lap joint, or by the use of a slotted junction block.

Other embodiments will occur to those skilled in the art and are within the following claims:

What is claimed is:

1. A pumping device comprising:

a housing;

a piezoelectric element having one end mounted to said housing and one end free;

a generally planar impeller blade connected to the free end of said piezoelectric element and having its distal end unconstrained by said housing; said blade having a Q-factor of at least eight, a stiffness-to-density ratio of more than one million newton-meters per kilogram and a mass per unit area which is less than 60% of the mass per unit area of said piezoelectric element; and means for applying a voltage to said piezoelectric element for oscillating its free end perpendicular to its plane at or close to resonance and propagating a traveling quadrature wave along said blade to generate and shed vortices at the distal end of said blade.

* * * * *